US006730003B1

(12) United States Patent
Phillips

(10) Patent No.: US 6,730,003 B1
(45) Date of Patent: May 4, 2004

(54) PEDAL ASSEMBLY FOR STATIONARY BICYCLE

(76) Inventor: Joe H. Phillips, 3633 E. Elm St., Phoenix, AZ (US) 85018

( * ) Notice: Subject to any disclaimer, the term of this patent is extended or adjusted under 35 U.S.C. 154(b) by 162 days.

(21) Appl. No.: 10/146,600

(22) Filed: May 14, 2002

(51) Int. Cl.[7] ..... A63B 69/16
(52) U.S. Cl. ..... 482/57
(58) Field of Search ..... 482/57, 58, 59, 482/79, 80; 280/282; 74/512, 513, 560, 594

(56) References Cited

U.S. PATENT DOCUMENTS 4,262,902 A * 4/1981 Dranselka ..... 482/60
4,973,046 A * 11/1990 Maxwell ..... 482/60
5,284,131 A * 2/1994 Gray ..... 601/36
5,449,332 A * 9/1995 Hervig ..... 482/57

* cited by examiner

*Primary Examiner*—Nicholas D. Lucchesi
*Assistant Examiner*—Tam Nguyen
(74) *Attorney, Agent, or Firm*—Gregory J. Nelson

(57) ABSTRACT

A pedal assembly for a stationary bicycle having a foot receiving platform. The pedal axle is located generally aligned with the heel of the user's foot when positioned on the platform. A counterbalance weight system rearward of the foot opposes the tendency of the pedal to "push over" the axle due to the rearward position of the axle. The pedal assembly design allows the user to effectively exercise the entire gluteal muscle group while simultaneously providing the user the ability to achieve an effective cardiovascular workout.

13 Claims, 17 Drawing Sheets

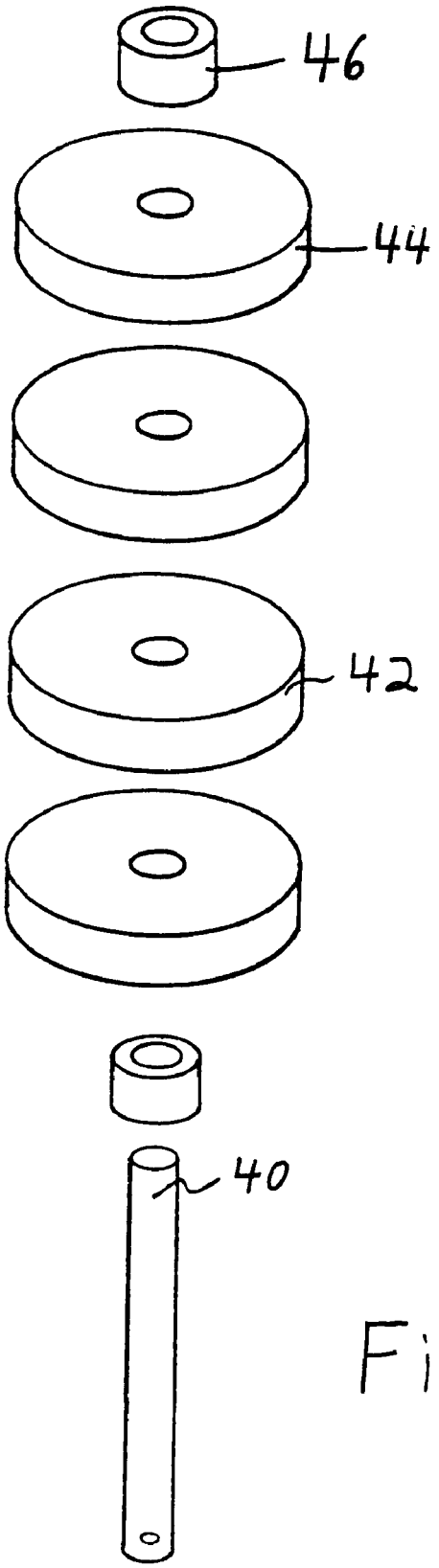
Fig. 5
Fig. 6b
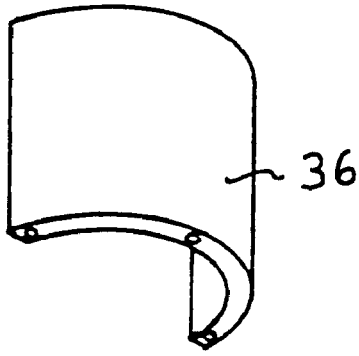
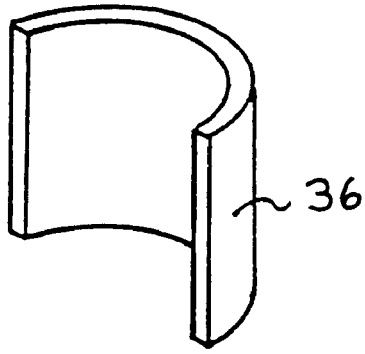
Fig 6a

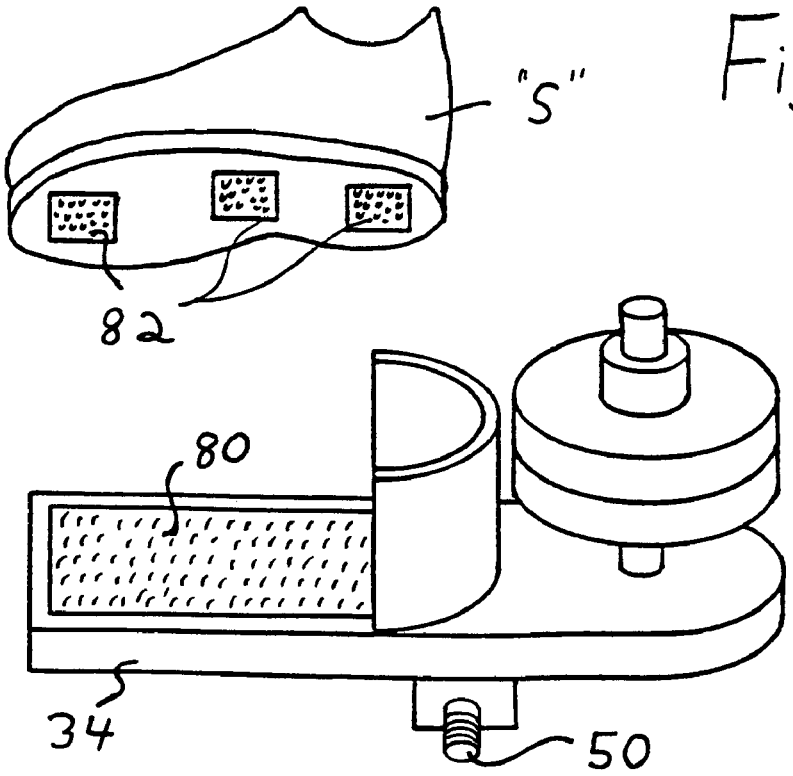
Fig. 9
Fig. 10
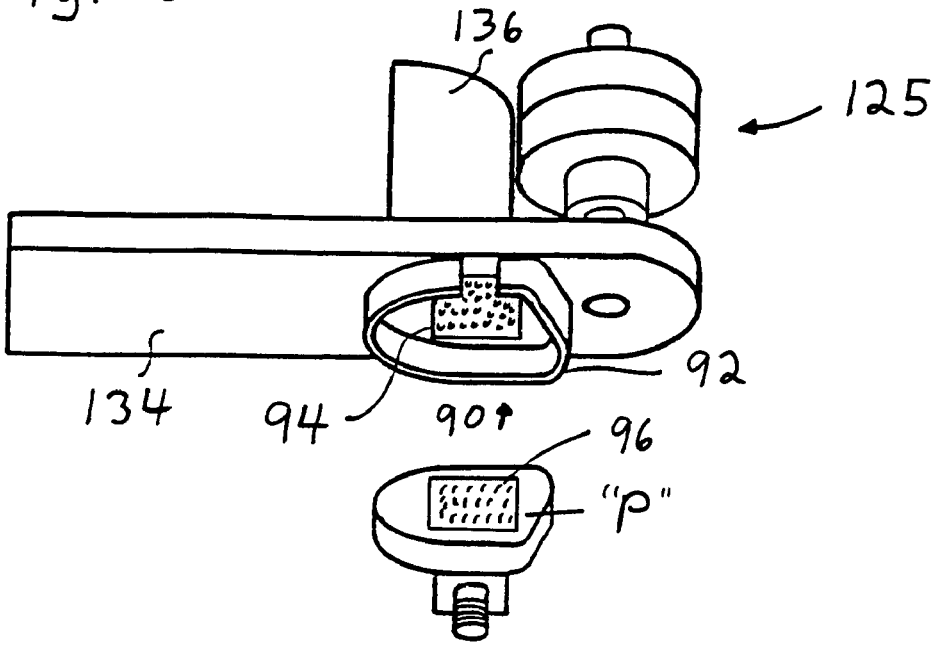

PEDAL ASSEMBLY FOR STATIONARY BICYCLE

FIELD OF THE INVENTION

The present invention relates generally to a pedal assembly for a stationary bicycle and more particularly relates to an improved stationary bicycle pedal design for effectively exercising the gluteal muscle group while simultaneously providing the user the ability to achieve an effective cardiovascular workout.

BACKGROUND OF THE INVENTION

Stationary bicycles are often used for conditioning, toning and rehabilitation, as they provide an exercise benefit to the calves, legs and thighs, as well as providing a cardiovascular workout. The advantage of a stationary recumbent bicycle, as opposed to a stationary upright bicycle, is that the user is positioned in a sitting position with the legs extending forwardly which reduces strain and stress on the spine and back muscles. However, use of a stationary recumbent bicycle with a conventional pedal is ineffective in achieving firming, toning and building of the gluteal muscle group, especially the gluteus maximus. The gluteus maximus is a large muscle with origin in iliac.

Effective firming, toning and strengthening of the gluteus maximus muscles requires an exercise movement that is both highly effective in engaging the gluteus maximus muscles and one in which a high number of repetitions can be comfortably performed. Conventional pedals used on stationary bicycles are not highly effective in engaging the gluteus maximus muscles. As a result, stationary bikes are generally not effective in firming and toning these muscles.

There are various exercises such as squats, lunges, walking or running up hills, or climbing stairs that will help to strengthen and tone the gluteus maximus muscles. The most effective of these, the squat and the lunge, are rather awkward and uncomfortable to perform. Cardiovascular machines, such as stair climbers and treadmills, may also assist in toning and strengthening these muscles, and can be used to comfortably perform hundreds of repetitions. However, these machines engage the gluteus maximus muscles to a lesser degree, limiting their overall effectiveness. Some specialized machines, such as that sold under the trademark "BUTT BLASTER," are more effective in engaging the gluteus maximus muscles, but are not designed for the comfortable execution of several hundred repetitions. Also, these specialized types of devices may not be available. Further, performing gluteal isolative exercises such as walking up hills or inclines, climbing stairs, and the like, is not always possible, particularly if the individual suffers from knee problems and is subject to knee strain.

The patent literature also suggests bicycle pedal designs which are intended to increase the exercise benefit such as the following:

U.S. Pat. No. 5,662,066 shows a bicycle pedal assembly that can be affixed to a bicycle crank arm. A pedal on the pedal axle has a length to extend beneath the foot. The pedal includes a portion to support the ball of the foot of the cyclist positioned directly above the pedal axle. The pedal also includes a rear-end heel attaching arrangement. Mounted between the pedal and the pedal axle is a free-wheel device which enables free rotation of the pedal relative to the pedal axle in a direction opposite to the direction of drive rotation. As a result, during the up pedaling phase of the free-wheel device creates a moment arm extension resulting in the increased upward pulling force.

U.S. Pat. No. 4,915,374 shows a recumbent exercise cycle having a pair of pedals and a seat. The pedals are individually adjustable relative to a crank shaft that is rotatably mounted on the frame of the exercise cycle. In combination, each pedal is connected by an extension arm to a point on a crank arm for movement of the pedal along a circular path about the point on the crank arm. The crank arm is connected to the crank shaft for movement of the point along the circular path about the crank shaft.

However, despite the availability of devices and exercises as described above, there exists the need for a pedal for a stationary bicycle which will provide the user a highly effective gluteal isolative workout which will assist in firming and toning the gluteus maximus, and also provide the user the ability to achieve an effective cardiovascular workout.

BRIEF SUMMARY OF THE INVENTION

The present invention provides a stationary bicycle pedal which provides the user an effective workout for the gluteal muscle muscles while simultaneously providing the user the ability to achieve an effective cardiovascular workout. In a preferred embodiment, the pedal is intended for use with a stationary recumbent bicycle. The pedal of the present invention serves to effectively isolate and engage the gluteus maximus muscles and is designed to position the foot so that the heel of the user's foot is substantially over the pedal axle. This relative positioning engages the gluteal muscle group when a pushing force is applied to the pedal via the heel. However, this positioning of the foot relative to the pedal axle causes a problem as it creates a tendency for the foot to push over and around the axle. The force on the pedal not only pushes down on the axle but also creates a movement about the pedal axle. Accordingly, the pedal of the present invention has a platform for the foot which positions the heel over the axle. A weight system at the rear of the platform provides an adjustable counter-balance to resist and oppose the tendency of the foot to push over the axle. With the weight system properly adjusted, the pedaling motion is smooth and balanced. The weight system may include a shaft on which weights are manually positioned either vertically or horizontally with respect to the platform. In another embodiment, the shaft is a lead screw remotely operated by a motor so the position of weights along the lead screw can be selectively positioned by the user during exercise to vary the exercise benefit and balance the pedaling motion. The pedal may be provided either as an OEM item or as an accessory for the aftermarket.

BRIEF DESCRIPTION OF THE DRAWINGS

The above and other objects and advantages of the present invention will become more apparent from the following description, claims and drawings in which:

FIG. 5 is an exploded view of the counter-balance weight assembly seen in FIGS. 2A, 2B and 3;

FIGS. 6A and 6B are perspective views of the top and the bottom of the heel retainer;

FIG. 9 shows a user's foot positioned above the pedal assembly;

FIG. 10 illustrates a variation of the invention, which adapts to a conventional pedal;

DETAILED DESCRIPTION OF THE DRAWINGS

Figure 1:
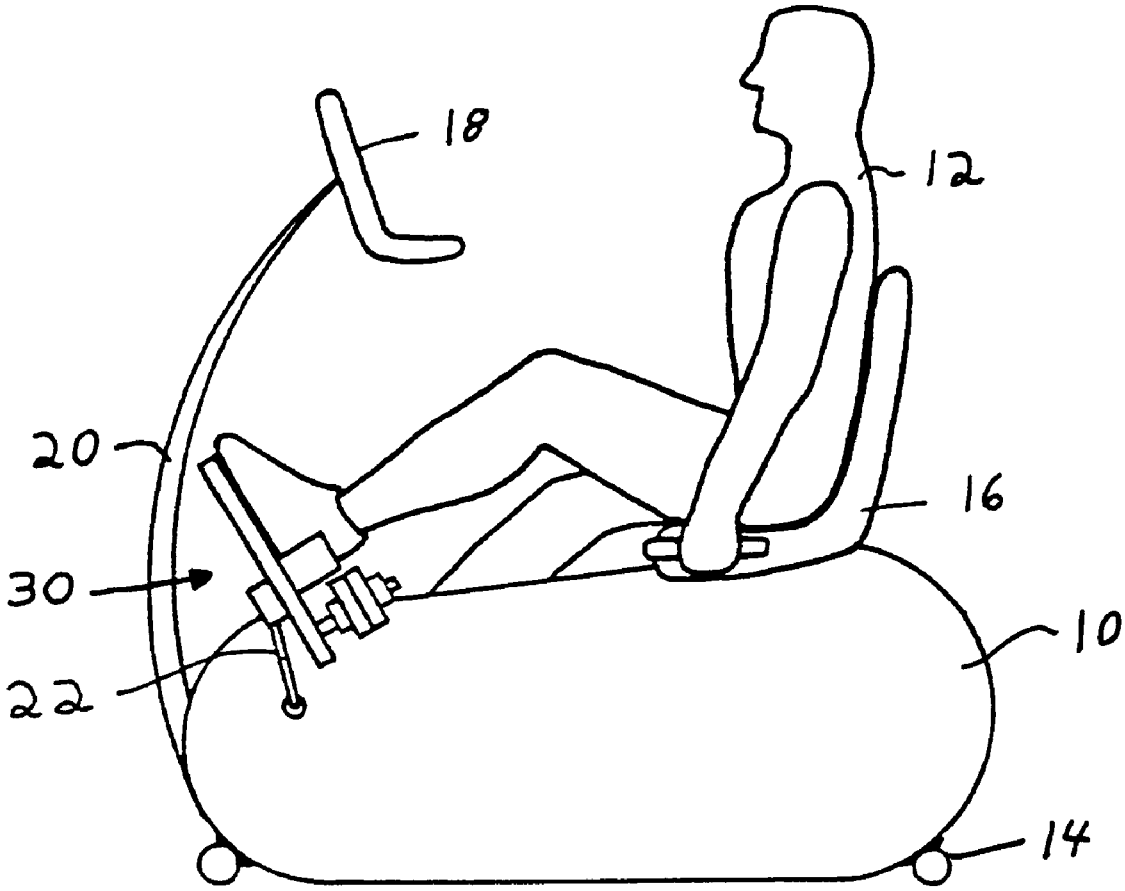
FIG. 1 is a side view of a stationary recumbent bicycle having a pedal assembly according to the present invention.

Turning now to the drawings, FIG. 1 illustrates a recumbent exercise cycle generally designated by the numeral 10. It is noted that throughout the various views, the same numerals have been used to identify the same or similar components or elements. An individual 12 is shown seated on the exercise cycle in position to use the cycle for exercise and rehabilitation therapy. The exercise cycle comprises a frame 14 on which a seat 16 is adjustably mounted. An optional display monitor 18 may be provided for indicating pedal cadence, speed, work effort and, in addition, physiological information, such as the user's heart rate. The monitor 18 is mounted on arm 20 in a position so that it may be viewed by the user. The remaining components of the bicycle are more or less conventional and further detail description is not believed necessary as they are well known to those skilled in the art.

The recumbent bicycle 10 is provided with a crank arm 22 having an axle which is secured to the pedal assembly 30, which is connected to a drive which provides resistance to achieve an exercise benefit. The pedal assembly 30 is shown in greater detail in FIGS. 2A through 8. The pedal assembly includes a platform 34 having a generally planar upper surface 35. The platform may be of any rigid material including hardwood, metal or plastic. The platform 34 is generally rectangular and has an arcuate heel retainer 36 disposed at an intermediate location. The area 35 of the platform forward of the heel retainer 36 has a length and .a width sufficient to accommodate the foot of the user. The area 38 of the platform 34 disposed rearwardly of heel retainer 36 carries a counter-balance weight assembly 25 having a vertically extending post or shaft 40. The shaft 40 is adapted to receive one or more weights 42, 44. Each of the weights has a central bore that may be fitted over the shaft. The shaft carries a pair of opposed locking collars 45, 46 to secure the weights on the shaft against movement.

Figure 4A:
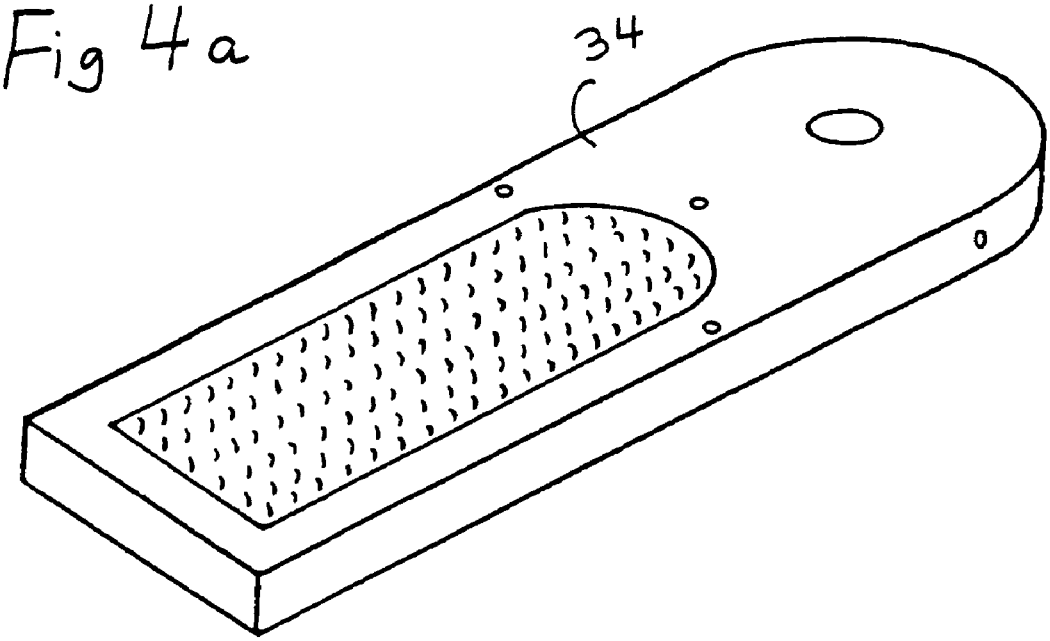
FIGS. 4A and 4B are perspective views of the top and the bottom, respectively, of the pedal platform.
Figure 4B:
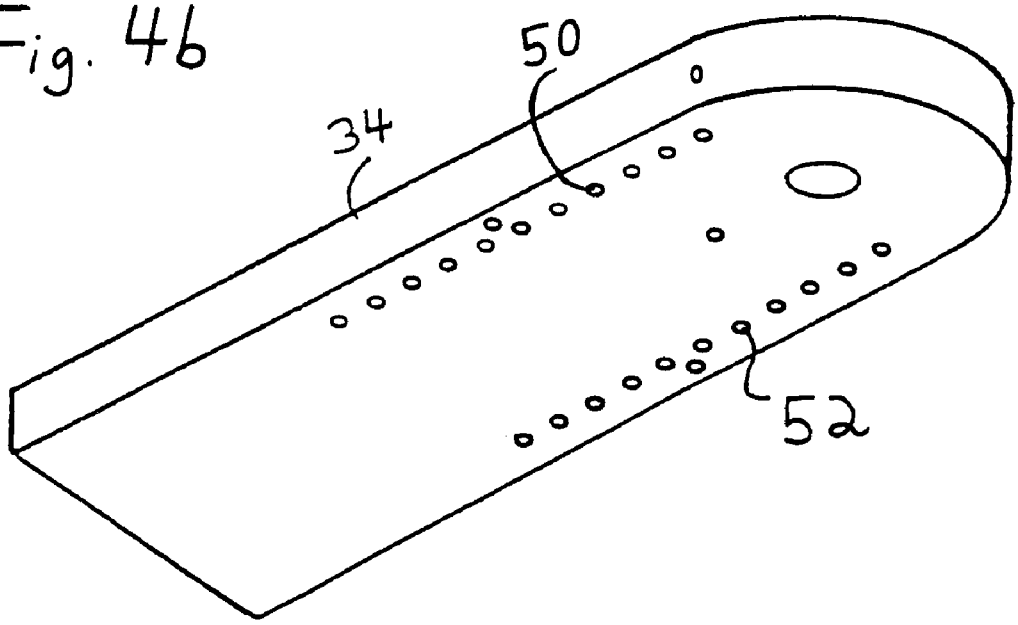
Figure 8:
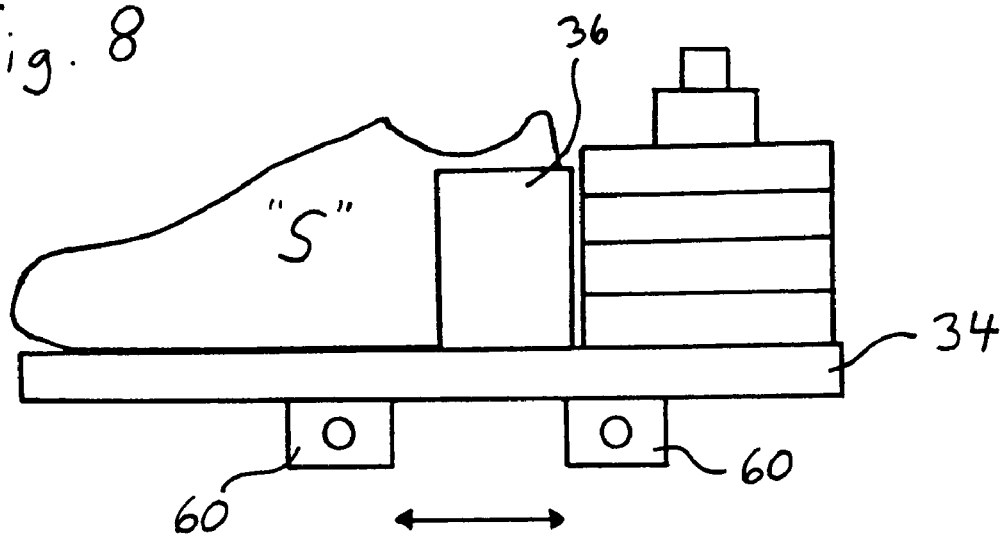
FIG. 8 is a side view of the pedal assembly with a cyclist's foot in position illustrating the axle position range.

As best seen in FIG. 4B, the underside of the platform 34 is provided a plurality of aligned bores 50 and 52. These bores are threaded and are arranged extending parallel along the opposite sides of the platform. The pattern of bores allows axle block 60 to be selectively positioned on the underside of the platform 20 in a position from about 1" behind the heel retainer 36 to about 6" forward of the heel retainer 36, as seen in FIG. 8.

Figure 3:
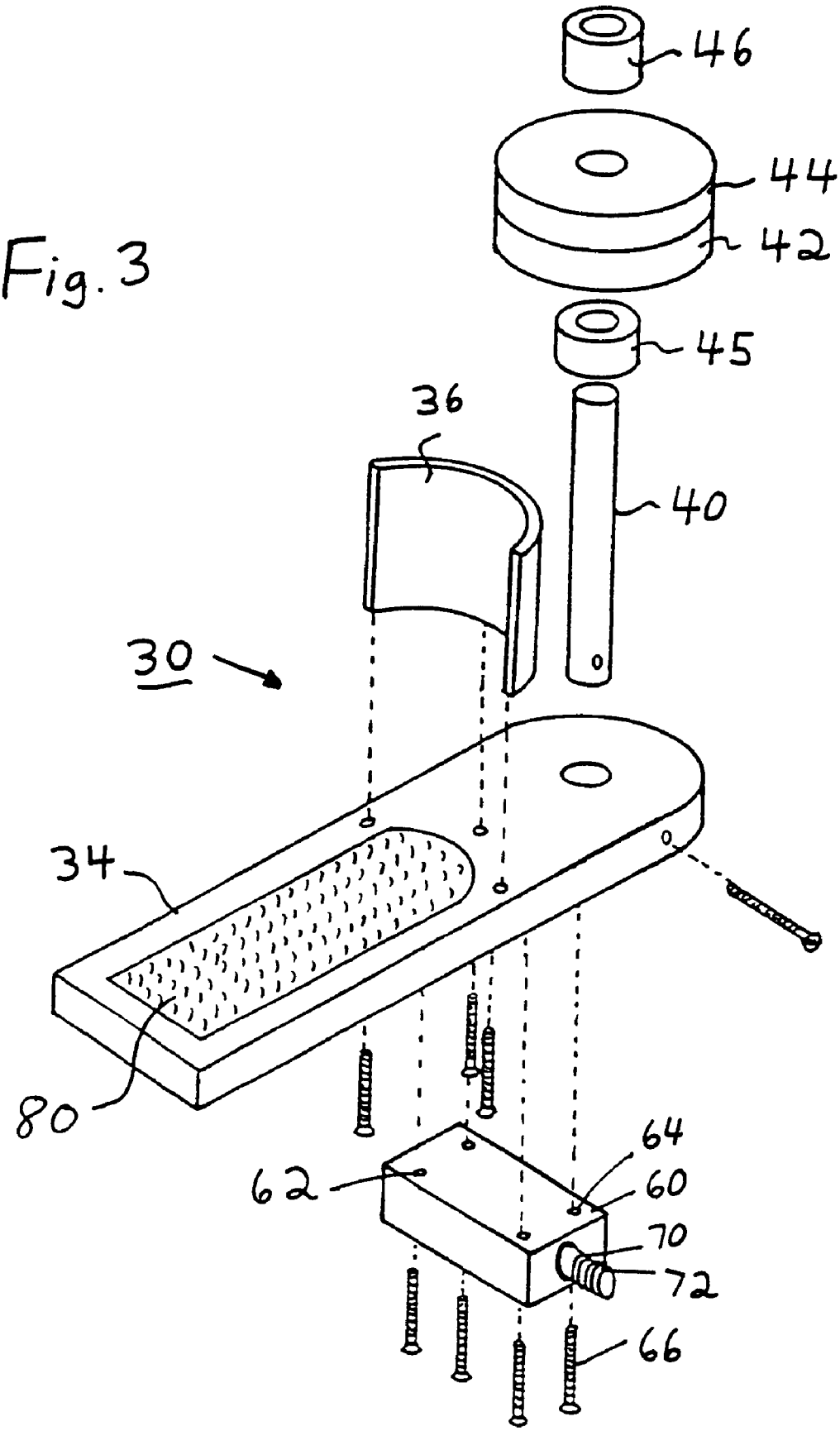
FIG. 3 is an exploded perspective view of the pedal assembly of the present invention.

The axle block 60 is provided with apertures 62, 64 at opposite ends which bores may be placed in registry with selected apertures 50, 52 on the platform. The block may be secured thereto by screws 66 as seen in FIG. 3.

Figure 7:
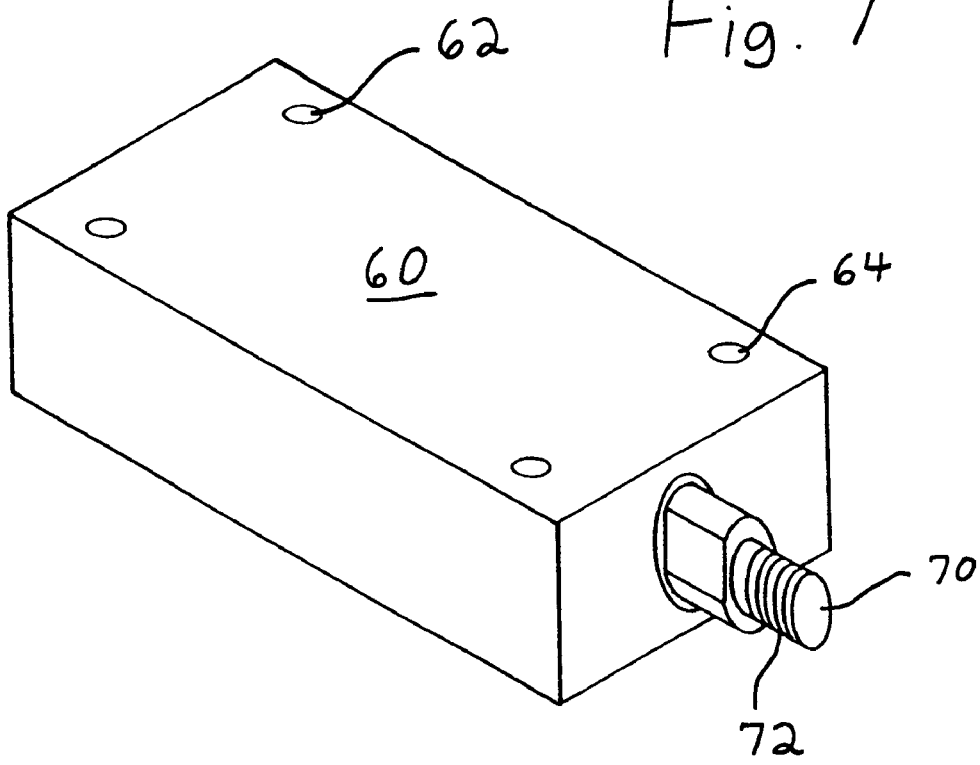
FIG. 7 is a perspective view of the pedal's axle block.

An axle 70 having a threaded end 72 extends from the side of axle block 60, as seen in FIG. 7. The threaded end is securable to the threaded bore in the crank arm as is conventional. An existing pedal can be removed, replaced with the axle block 60. It will be appreciated that a pair of pedal assemblies will be provided, one for the left and one for the right side of the bicycle. The left side and right side assemblies are oppositely threaded and are thus marked "R" for right and "L" for left, as is known in the art.

The weight post 40 may be a made of steel, plastic or hardwood, typically about 1" diameter. The post may be permanently secured to the platform by an adhesive or fastener or may be screwed into a threaded bore in the platform. Weight plates 42, 44 of different sizes, for example, 5 lbs., 2.5 lbs., and 1.25 lbs., are provided so that various weight combinations can be attached to the platform. FIG. 5 shows an exploded view of the weight supporting post and various weights which may be attached thereto and secured by collars 45, 46 abutting the upper and lower weights, respectively.

FIG. 8 is a side view showing the shoe "S" of a user positioned on the platform 34 abutting the heel retainer 36. The axle block 60 is shown both in the forward most and rearward most positions and can be positioned in an intermediate position as well by selecting appropriate bores 50 and 52 in registry with bores 62, 64.

In order to provide increased friction between the sole of the user's shoe and the platform, the upper surface of the platform may be covered or partially covered with a frictional material 80. One preferred type of frictional material is a component of a loop and hook fastener material such as that sold under the trademark VELCRO®, which is applied to the platform. The other component 82 of a loop and hook fastener material can be applied to the sole of the user's shoe "S," as seen in FIG. 9. The material may be provided with adhesive backing and adhesively secured to the shoe sole. It is important that no slippage between the shoe and the platform 34 occur during use. Maintaining the rider's heel over the axle 50 in a stable condition is critical to the effectiveness of gluteal muscle isolation. An optional foot strap may also be included to provide additional security.

Figure 2A:
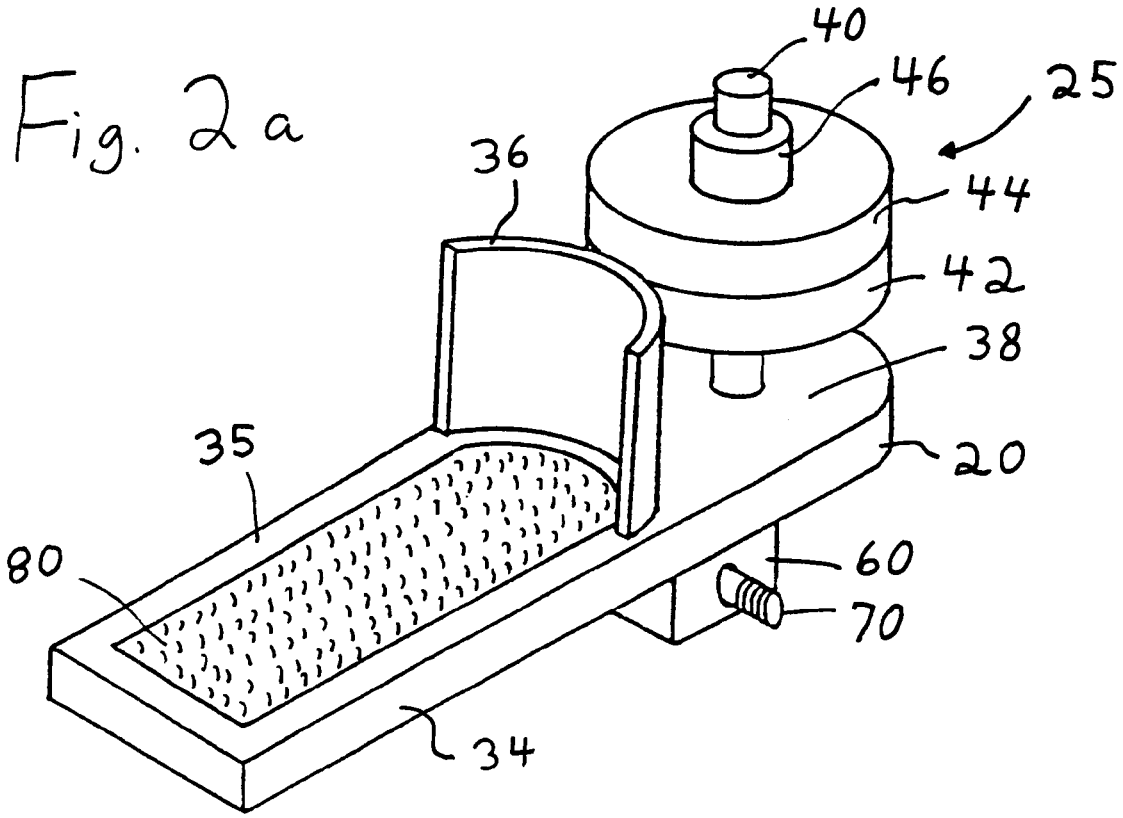
FIGS. 2A and 2B are a perspective view and side view, respectively, of the pedal assembly.
Figure 2B:
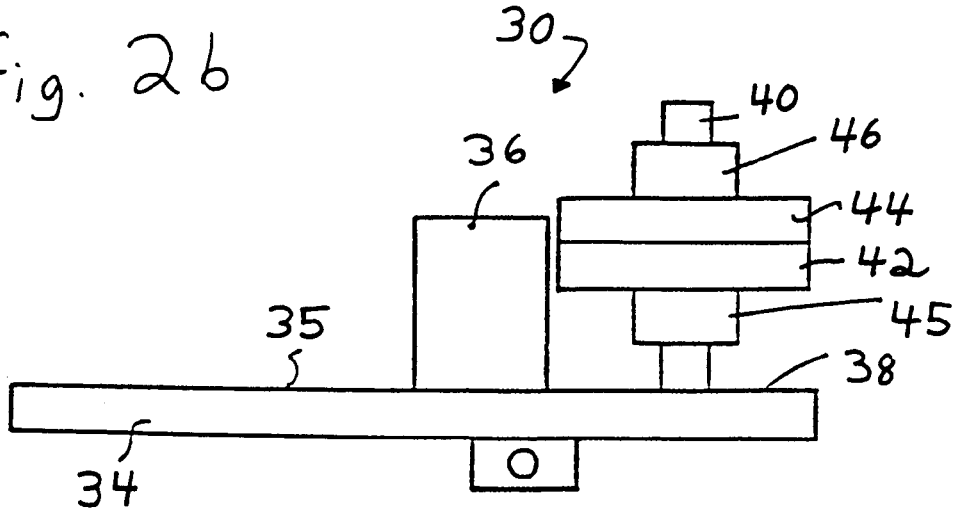
Figure 2C:
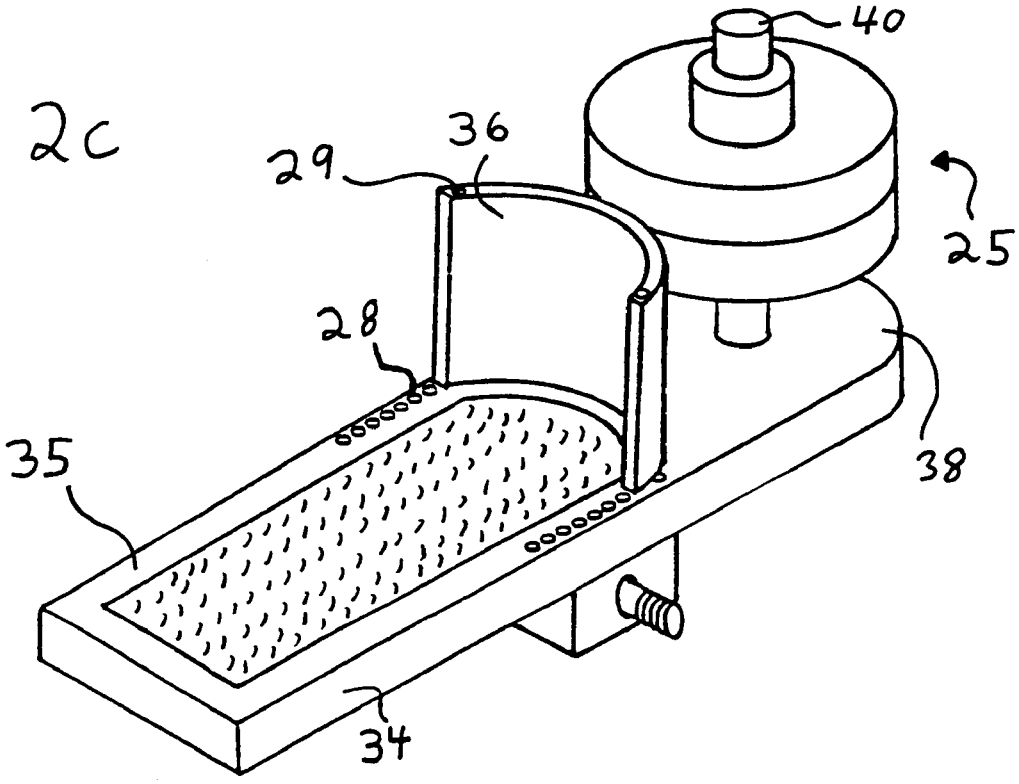
FIG. 2C is a perspective view of an alternate embodiment of the invention in which the heel retainer is adjustable along the platform.
Figure 2D:
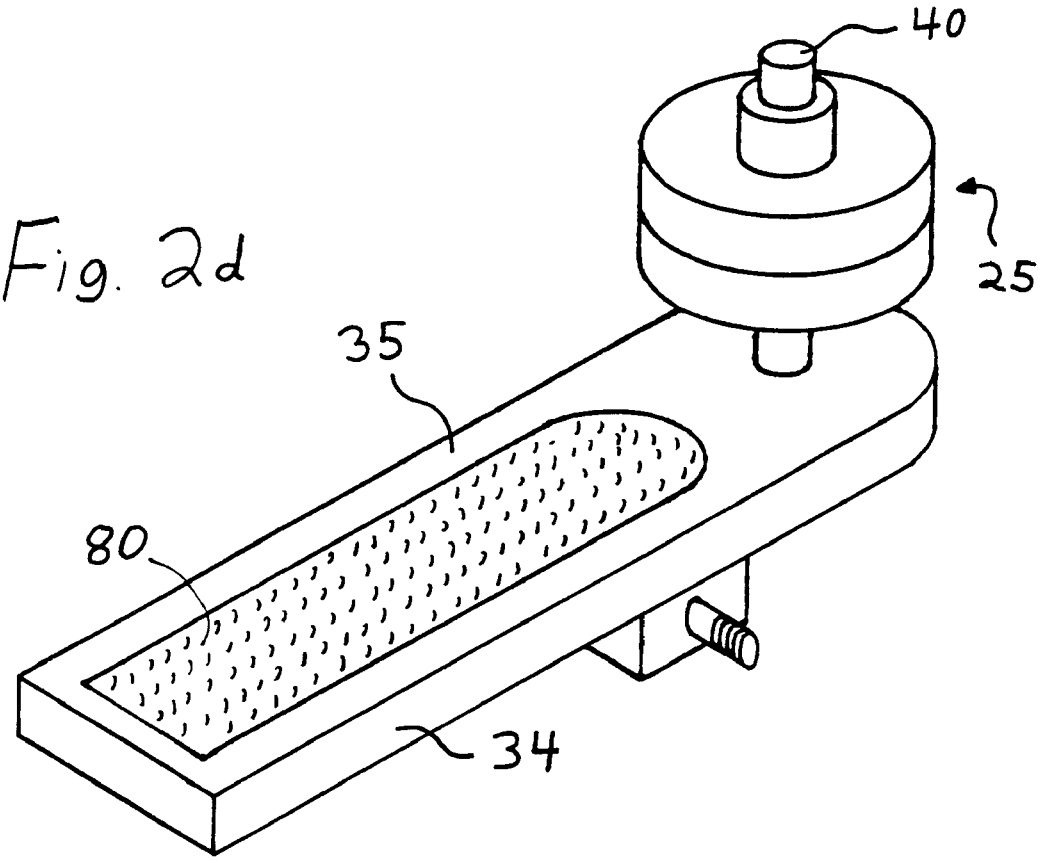
FIG. 2D is a perspective view of yet another embodiment which incorporates a section of a frictional material.

It is noted that in some applications, the heel retainer 36 may be eliminated as the frictional material 80 on the platform as seen in FIG. 2D may provide sufficient retention with the user's shoe.

In FIG. 2C, the retainer 36 is selectively postionable along platform surface 34 by inserting pins 29 through the retainer into the appropriate apertures 28 to achieve the desired exercise benefit and counter balance effect.

FIG. 10 illustrates an alternate form of the heel pedal assembly, again having a platform 134, heel retainer 136 and counter-balance weight system 125 rearward of the heel retainer. In FIG. 10, the pedal assembly is adapted to mount to a conventional bicycle pedal "P. " This conventional bicycle pedal has a pedal shape which is received within the pedal seat 90 on the underside of the pedal platform. The seat 90 is defined by a flange 92 conforming to the shape of the perimeter of the pedal "P" so the pedal will seat within the flange. To further provide security, the seat area 90 on the platform within the flange and the upper surface of the pedal can be provided with loop and hook fastener material components 94, 96.

Figure 11:
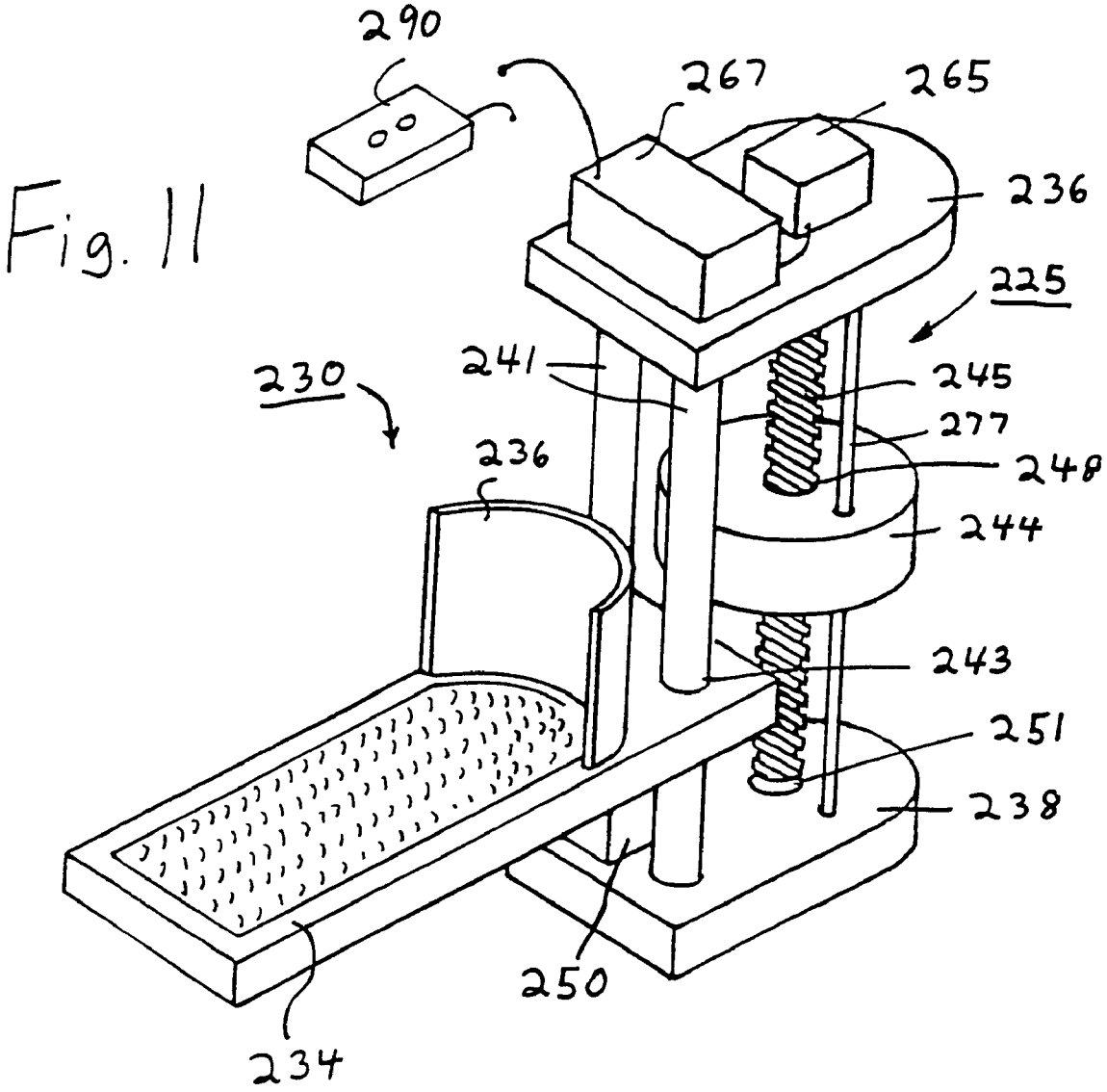
FIG. 11 is a perspective view of the invention using an alternate weight system having a remote-controlled electric motor to adjust the torque.

FIG. 11 is a perspective view illustrating another embodiment of the present invention designated by the numeral 230. In this embodiment, the platform 234 is provided with a heel retainer 236 at an intermediate location. Rearward of the heel retainer is the counter-balance system 225 having upper and lower mounting plates 236, 238 which are interconnected by a pair of fixed shafts 241 extending through the apertures 243 in the rear of the platform. A threaded lead screw 245 extends vertically, having its lower end received in bearings 251 in the lower plate 238. The upper end of the lead screw is connected to an electric motor 265 such as a small horse power DC motor which is reversibly controlled by a controller/power supply 267 which is remotely operable. A guide rod 277 extends parallel to the lead screw. One or more weights 244 have a threaded central bore 248 engageable with the lead screw. The guide rod 277 extends through an aperture extending through the weight, radially positioned from the center, to prevent rotation of the weights. An axle block 250 having an axle position, as described, is adjustably secured to the underside of the foot platform 234.

The advantage of the embodiment shown in FIG. 11 is the user can adjust the torque or counter-balance effect while pedaling. The user is provided with a remote control 290 which will enable the user to adjust the balance over the axle to increase or decrease the torque as necessary to achieve the necessary exercise benefit. The remote 290 may be hand-held or mounted on the console and may be hardwired to the controller or utilize a signal such as infrared (IR) or radio frequency (RF). The user may selectively position the weights 244 below or above the pedal platform 234. With the weights below the platform, the pedals will assume a generally vertical position when not in use which makes it easier for the cyclist to place both feet into the proper position when seated in the position shown in FIG. 1. Once pedaling is initiated, the weights can be remotely adjusted to a position to provide the proper balance for the individual.

Figure 12A:
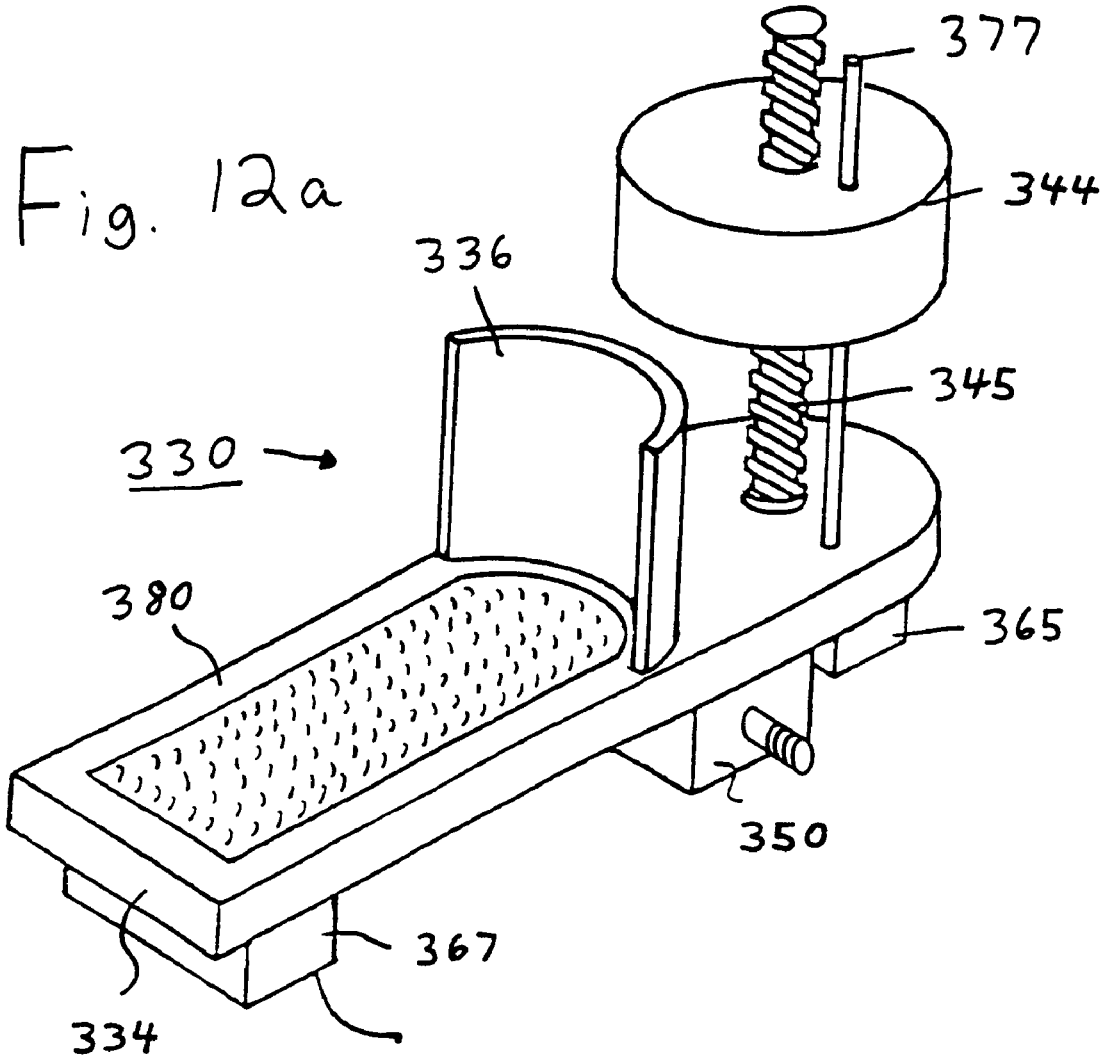
FIG. 12A is a perspective view of yet another embodiment of the present invention, which also uses a remote-controlled electric motor to adjust the torque.

FIG. 12A illustrates a simpler version of the remote controlled system shown in FIG. 11, generally designated by the numeral 330. In FIG. 12A, the foot platform 334 has an upper foot receiving area 380. The rear of the foot receiving area has a heel retainer 336. Rearward of the heel retainer, a threaded lead screw 345 is rotatably mounted in bearings at the rear of the platform. A guide rod 377 extends parallel to the lead screw extending through weight 344. Weight 344 has a threaded central bore which receives the lead screw and the guide rod 377 extends through an aperture in the weight. The lead screw is reversibly rotated by a small electric motor 365 which can be remotely controlled through controller/power supply 367 by a remote control unit held by the user or a control mounted on the display console. Again, the axle block 350 is located at a position generally below the heel of the user when the user's foot is positioned on the platform. The axle block 350 may be axially adjustable along the underside of the platform, as described above, with reference to FIG. 3.

Figure 12B:
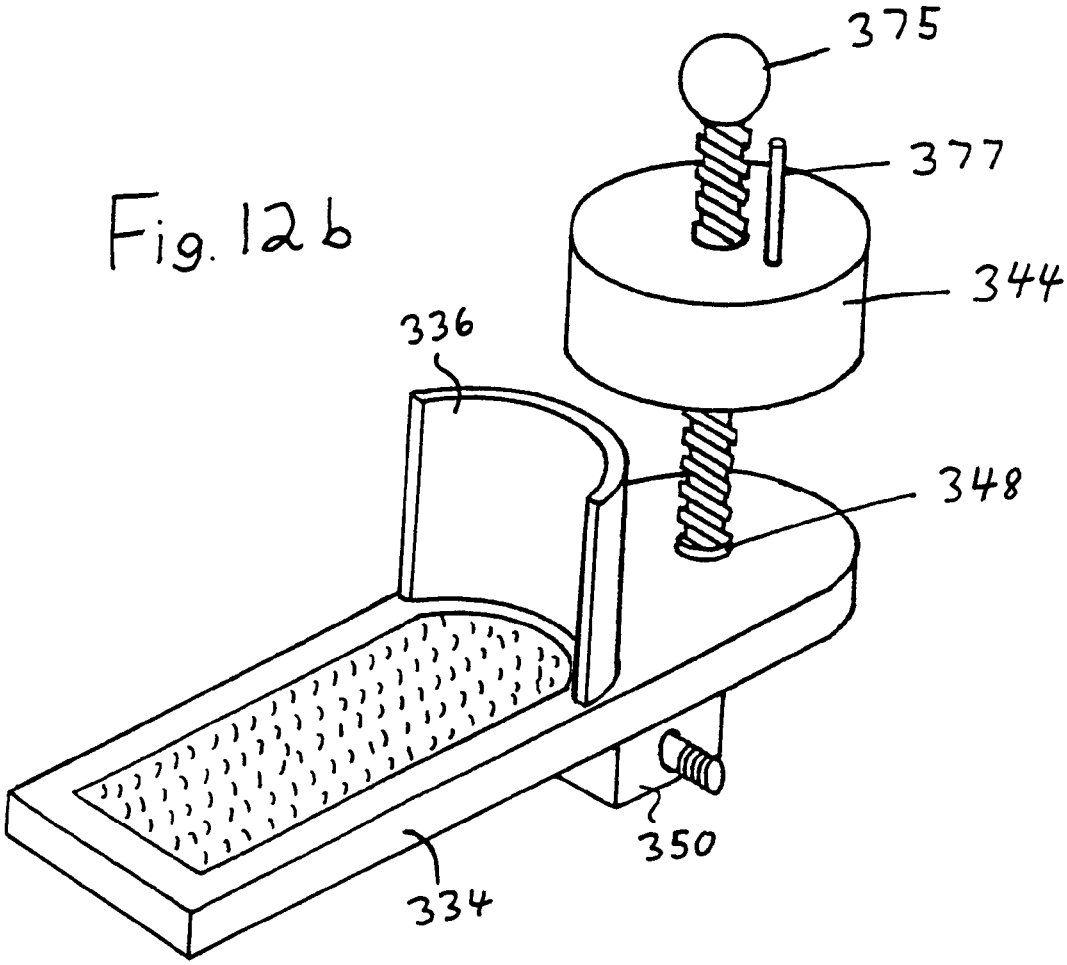
FIG. 12B shows an embodiment similar to 12A which provides for manual adjustment of the torque.

In FIG. 12B, platform 334 carries heel retainer 336 at the rear of the foot receiving area. Axle block 350 is positioned on the underside of the platform as has been described. Weight 344 receives lead screw 345 in a threaded central bore. The lead screw is rotatable in bearing 348. Guide rod 377 prevents the weight 344 from rotating. To adjust the position of the weight, the lead screw is manually rotated at knob 375 to adjust the vertical position of the weight.

Figure 13A:
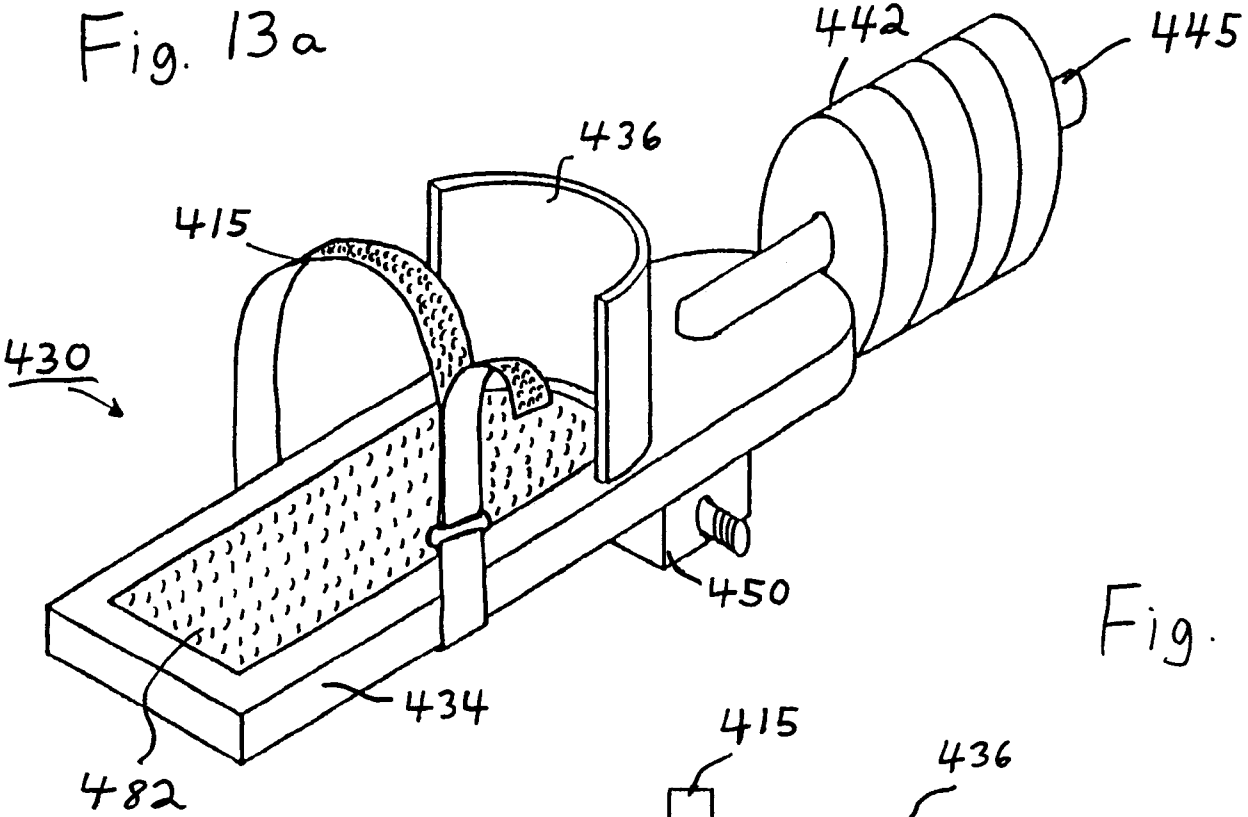
FIGS. 13A and 13B are a perspective view and a side view, respectively, of an alternate version of the invention designed for use on an upright stationary bicycle.
Figure 13B:
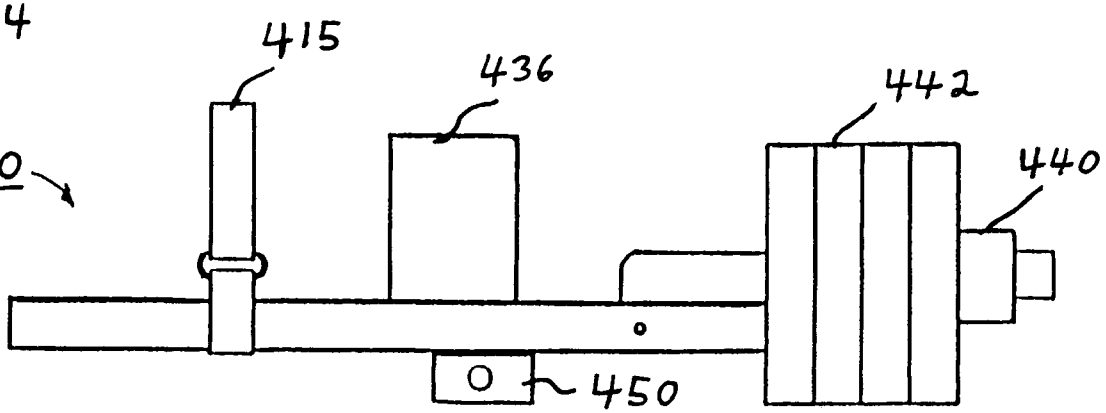

FIGS. 13A and 13B illustrate yet another embodiment of the present invention designated by the numeral 430. This embodiment has a foot platform 434 with an arcuate or curved heel retainer 436 located at an intermediate location. The foot receiving portion of the upper surface of the platform may be provided with a material 482 which will increase the frictional adherence to the sole of the user's shoe. An auxiliary strap 415 may also be provided for this purpose. Axle block 450 has an axle which is attachable to the crank of the recumbent bicycle in a location below the heel retainer 436.

A weight receiving shaft 445 is secured to the platform area rearward of the heel retainer and extends horizontally beyond the rear edge of the platform. Again, one or more weights 442 may be received on the shaft and secured in place by a locking collar 440. The pedal assembly of this embodiment is intended for use on a stationary upright, bicycle in contrast to the previously described embodiments which are intended for use on a stationary recumbent bicycle. The principle difference is in the positioning of the weight plates. The weight plates are positioned on the horizontally and rearwardly extending shaft with the weights positioned at the rear end of a platform.

Figure 14:
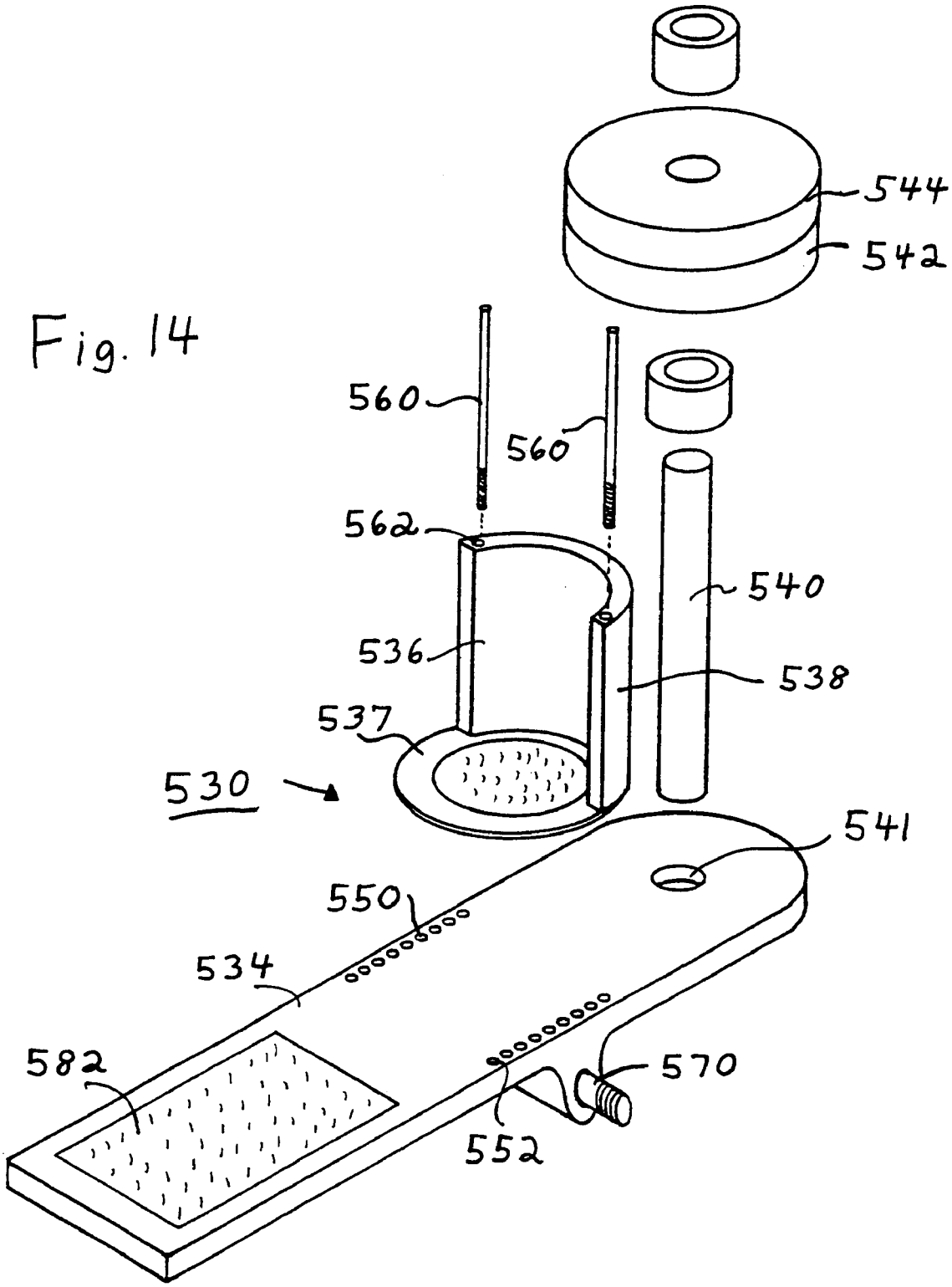
FIGS. 14 to 14E illustrate yet another embodiment of the present invention.
Figure 14A:
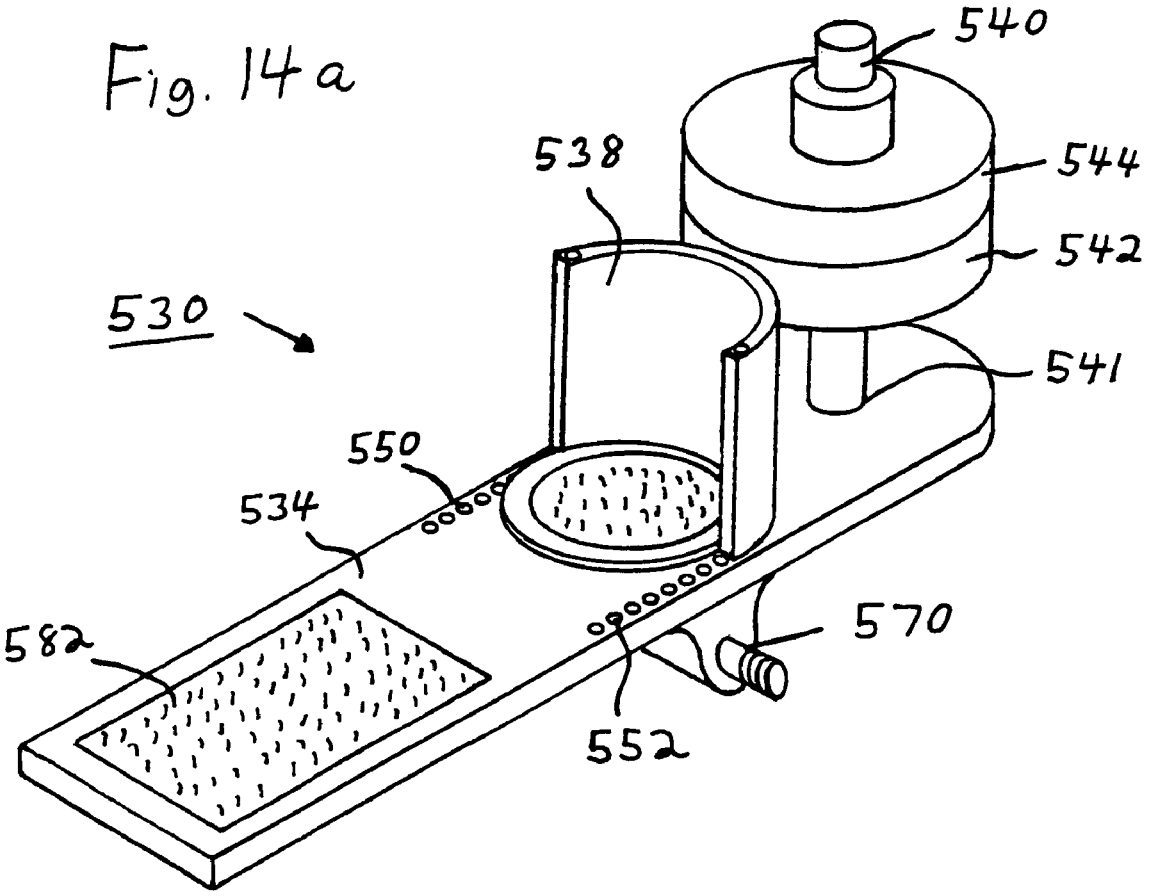
Figure 14B:
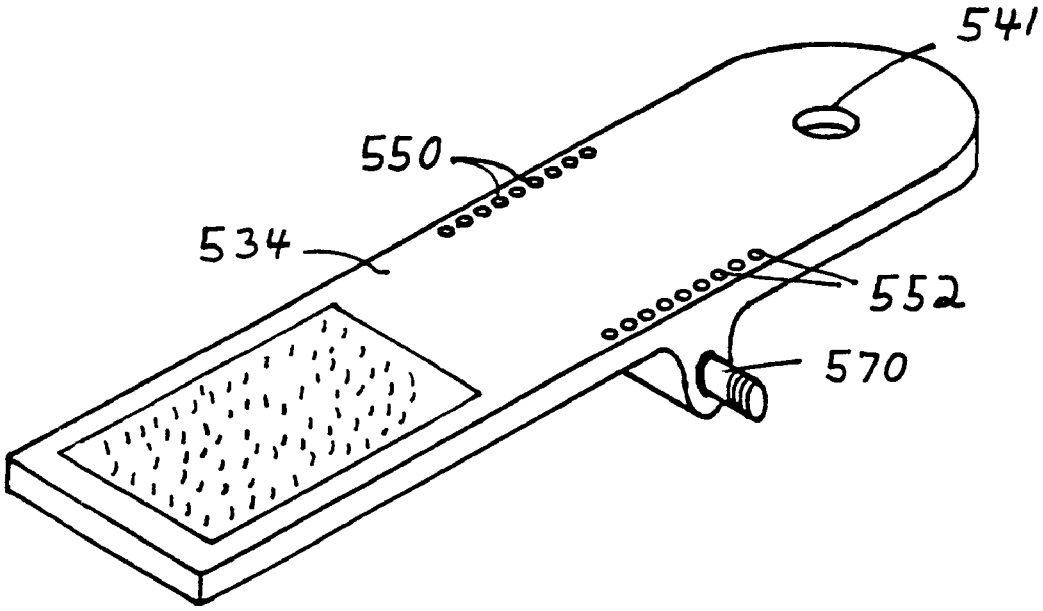
Figure 14C:
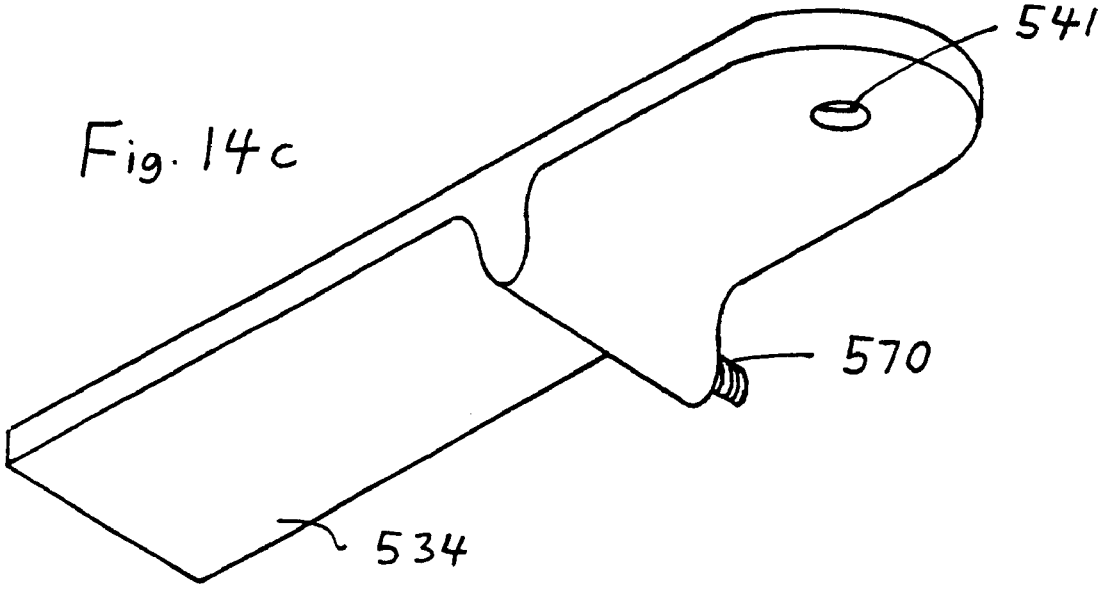
Figure 14D:
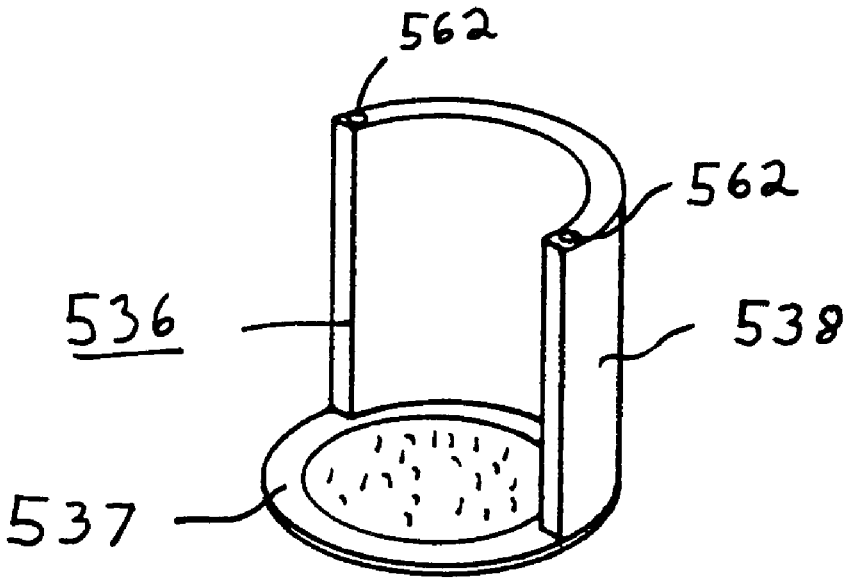
Figure 14E:
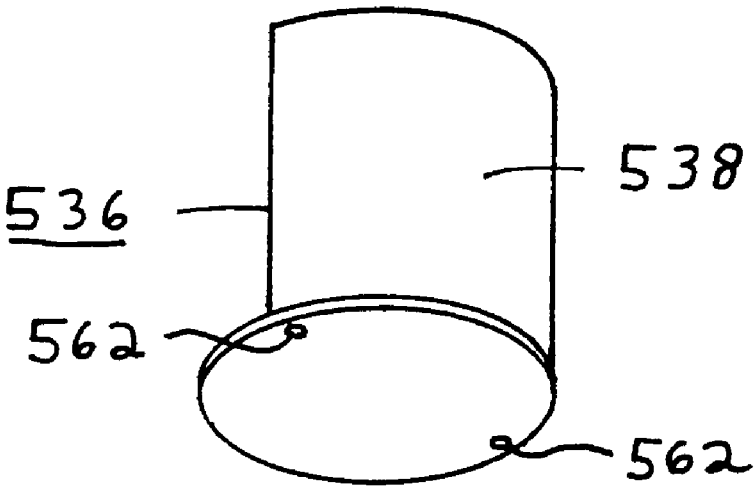

Turning to FIGS. 14 to 14E, the embodiment of the pedal assembly shown is designated by the numeral 530 having an elongate foot receiving platform 534 with a patch of frictional material 582 positioned at the forward end of the platform. Spaced-apart aligned series of bores 550 and 552 extend adjacent the sides of the platform.

Heel retainer 536 has a circular base 537 and an arcuate upstanding rear wall 538. Frictional material is applied to the base. The retainer 536 is a separate component, as seen in FIGS. 14D and 14E, and may be adjustably positioned relative to the base by inserting threaded rods 560 through the vertical bores 562 in the wall 538 into selected bores 550 and 552. Since the pedal axle 570 is fixed relative to the platform, the user may adjust the heel position and position weights 542, 544 on the shaft 540 located in bore 541 to achieve the desired counterbalancing effect. FIG. 14A shows the heel retainer 538 positioned generally directly above the axle 570.

Figure 15:
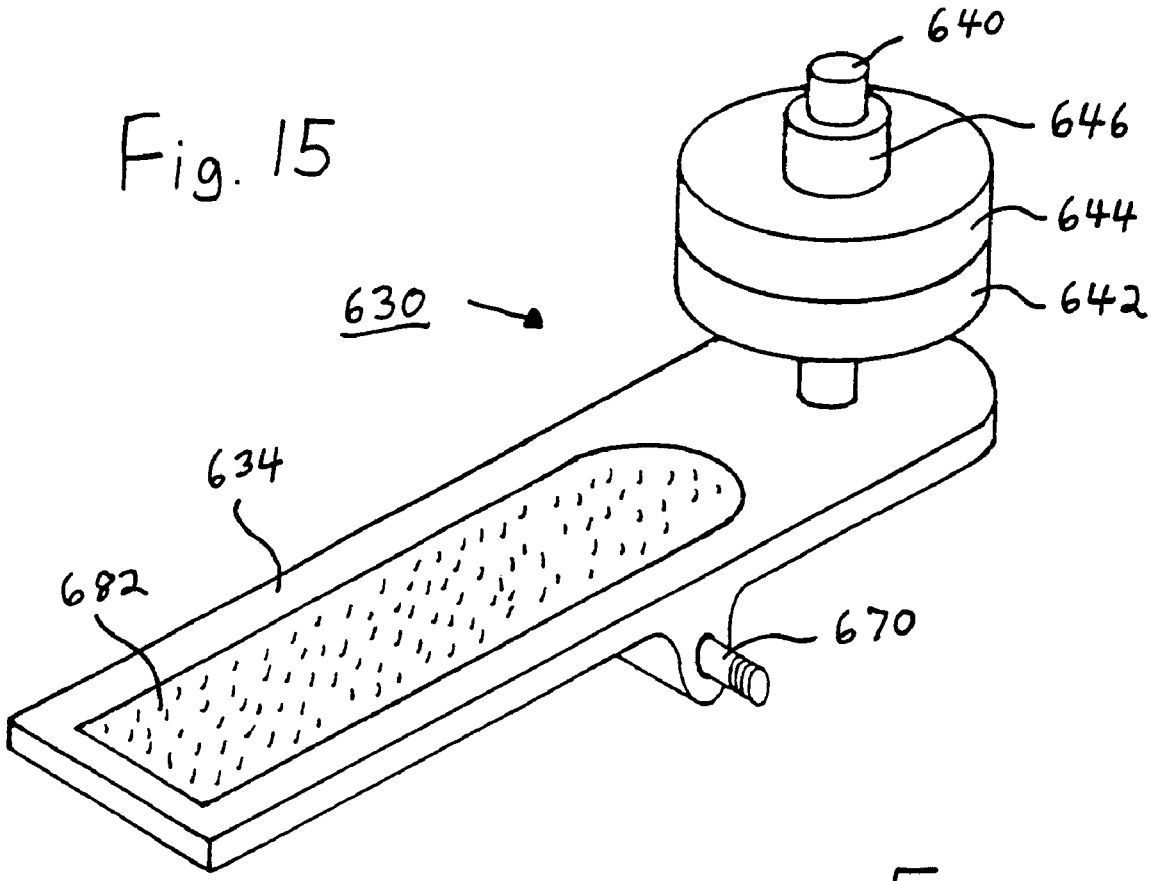
FIG. 15 is a perspective view of still another embodiment of the pedal assembly.

In FIG. 15, a simplified version of the pedal assembly is designated by the numeral 630 and has a foot receiving platform 634 with a section of material 682 to frictionally engage the sole of the user's shoe or foot. The axle 670 is fixed to the underside of the platform and may be threaded to the crank. Counterbalancing is achieved by weights 642, 644 positioned on shaft 640 and secured by locking collar 646. The user will selectively position his or her foot relative to section 682 to achieve the desired exercise benefit.

Figure 16:
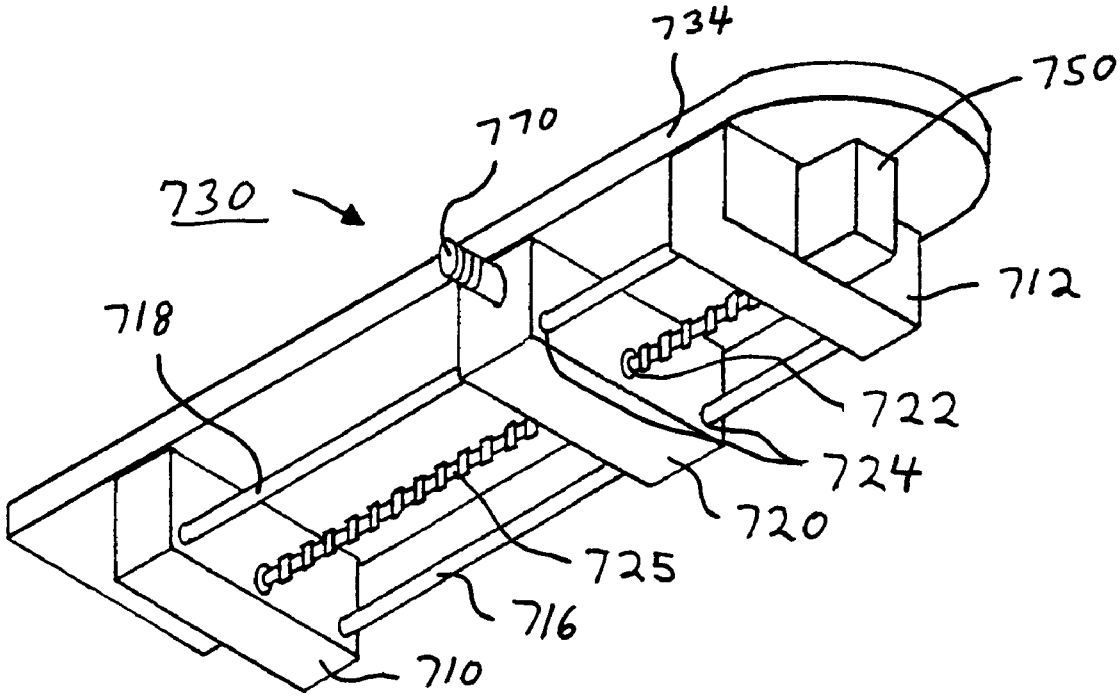
FIG. 16 is a bottom perspective view of a pedal sub-assembly.

In FIG. 16, the pedal sub-assembly 730 has a platform 734 which receives the user's foot on its upper surface. The bottom surface is provided with spaced-apart, fixed mounting blocks 710, 712 adjacent the ends of the platform. Guide rods 716, 718 extend between the mounting blocks. An axle block 720 has axial bores 724 through which the guide rods extend so the axle block 720 is reciprocable along the bottom of the platform 734. A lead screw 725 extends through a threaded bore 722 in the axle block 720 so the block is positionable relative to the platform by rotating the screw in one direction or the other. The lead screw may be manually driven but is preferably driven by a small DC reversible motor 750 which is selectively controlled by the user. With this embodiment, the user can position the axle 770 at a desired position relative to the user's foot to achieve exercise benefit. Weights may be applied to achieve counterbalancing as has been described above.

Operational Principles

With the pedal assembly of the present invention, the heel retainer is positioned generally above the axle. This positions the user's heel above the axle, contrary to conventional cycle pedals which are designed to position the ball or the middle of the foot over the axle. However, positioning much of the foot in front of the axle will create a significant torque force around the axle. This torque force increases as the foot is moved forward relative to the axle. For example, if the foot is slightly forward its middle, the resulting torque force is correspondingly slight. If it is moved to a position so that approximately the rear ¼ of the foot is over the axle, the torque force is significantly increased. If the foot is moved forward so that the back of the heel is over the axle, the torque is substantial. In these latter two locations, the rider must flex his or her foot strongly upward holding his or her toes up. This places a large strain on the muscles around the shin so that they will become tired and exhaust within a short period of time forcing the rider to stop the exercise. The pedal of the present invention counters this torque force by using a weight system as a counterbalance. The balancing force allows normal and relaxed pedaling with the feet in the extreme forward position relative to the axle. Tests have shown a pedal of this design will effectively engage the rider's gluteus maximus muscles far more effectively than with a pedal having a standard foot position.

Use

In use, the user will adhesively attach one part of a loop and hook material patch adhesively to the bottom of each shoe. Next the user will adjust the weight system to suit his or her requirements. The amount of weight and the location of weight are determined by a number of factors such as the shoe size and the position of the heel relative the axle. The larger the shoe size and the further forward the heel retainer relative the axle, the greater the lever effect, thus requiring more counter-torque for effective counterbalancing. One way to increase torque without increasing weight is to move the weights higher up on the weight post rather than placing them toward the bottom. Once the selected weights have been placed in position on the weight post, the user will assume a seated position on the recumbent bicycle placing each foot on to the platform with the heel resting against the heel retainer. This is shown in FIG. 1. The user will then push each foot forward and downward against the platform so the loop and hook fasteners will become fully engaged. If foot straps are also used, they will be secured at this time. One may also select and position weights which over compensate for the movement effect, in which case use will isolate the quadricep muscles.

The user is now ready to begin pedaling. Due to the added weight, as well as becoming accustomed to the feel of balancing, the user will generally begin pedaling at a slower rate. At first the user may need to concentrate on pushing the pedal with his heel since riders are generally accustomed to pushing the pedal with the ball of their foot. Gluteal engagement occurs on the pushing part of the pedaling cycle only. Thus, the rider needs to exert force on the push portion of the pedaling cycle with little or no force being required on the return or pull portion of the pedaling cycles. Many riders or users may do this anyway, though some are accustomed to using foot straps, enabling the foot to pull on the pedal as well as push. The following describes various exercise routines and their benefits:

1. Rapid-fire repetitions executed for 10 to 15 minutes. This type of exercise can be especially effective in exhausting the large and powerful gluteal muscles. The keys to the effectiveness of rapid-fire reps are:
   a. Many reps in a relatively short time. Riding at 60 rpm for 12 minutes results in the execution of 720 reps; 15 minutes at 80 rpm=1200 reps. Contrast this to the time required to perform a comparable number of squats or lunges.
   b. The contraction-recovery cycle is very fast, only one second for a complete cycle for each leg every second at 60 rpm.
2. The foot is relaxed, pushing the pedal primarily using the heel, as the forces are in balance. Pushing with the heel in the recumbent position effectively engages the gluteus maximus muscles.
3. Most, if not all, of the entire gluteal muscle group is engaged when using the invention. This is due to its isolative nature in combination with the constant change in the angle of force involved in each repetition. The pedaling motion pushes through the full range of angles from the top of the pushing cycle, where it is almost straight forward, through to straight away, then through to almost straight backwards, 90° forward, straight away and 90° backwards. This complete range of engagement throughout pedal rotation helps exercise every part of the gluteal muscle group. And they are engaged every time, over and over again in quick succession, on and on for minutes at a time.
4. The gluteal muscle group may be the most difficult to exhaust. This is due to a number of factors:
   a. They are difficult to isolate. This creates a situation where the other muscles involved in the exercise will exhaust before the glutes.
   b. They must be effectively engaged for a fairly long period of time. It takes a prolonged and constant engagement of the glutes to cause them to become significantly exhausted.
5. Continuous movement: This allows a large number of reps to be performed in 12 minutes, from 500–1200 @ 40–100 rpm.
6. Use of the present invention impacts minimal strain on the joints involved, primarily the knee and the ankle. When compared to the extend-stop-return-stop-extend cycle of other exercises, the difference is considerable.

It will be obvious to those skilled in the art to make various changes, alterations and modifications to the invention described herein. To the extent these various changes, alterations and modifications do not depart from the spirit and scope of the appended claims, they are intended to be encompassed therein.

I claim:

1. A pedal for a stationary bicycle of the type having a crank arm, said pedal being rotated by the foot of a user comprising:

(a) a foot platform having a top and bottom surface;

(b) retainer means on said platform to establish the position of the rider's foot on the platform;

(c) a pedal axle on said platform generally alignable with the heel of the rider's foot when the foot is on the platform, said pedal axle attachable to the crank arm; and (d) counterbalance means to assist in maintaining the pedal assembly in a balanced condition as the pedal is rotated.

2. The pedal for a stationary bicycle of claim 1 wherein said pedal axle is selectively positionable along the bottom of said platform.

3. The pedal for a stationary bicycle of claim 1 wherein said counterbalance means comprise a weight adjustably positioned on a shaft rearward of said retainer.

4. The pedal for a stationary bicycle of claim 3 wherein said shaft is generally vertical with respect to said platform.

5. The pedal for a stationary bicycle of claim 3 wherein said shaft is generally horizontal with respect to said platform.

6. The pedal for a stationary bicycle of claim 3 wherein said shaft is a lead screw connected to a motor and wherein said weight is in threaded engagement with said lead screw and is reversibly moveable therealong.

7. The pedal for a stationary bicycle of claim 1 wherein said upper surface of said platform in the foot receiving area is provided with a friction enhancing material to prevent slippage of the foot.

8. The pedal for a stationary bicycle of claim 7 wherein said material is a component of a loop and hook fastener.

9. The pedal for a stationary bicycle of claim 8 wherein said rider's foot is in a shoe having mating loop and hook fastener component on the sole.

10. The pedal for a stationary bicycle of claim 6 wherein said motor is remotely and reversibly actuated.

11. The pedal for a stationary bicycle of claim 1 wherein said pedal axle is a component of a standard pedal on said crank arm and further including seat means on the bottom of said platform to receive and retain said standard pedal.

12. The pedal for a stationary bicycle of claim 3 wherein said shaft extends vertically from a location above the platform to a location below the platform.

13. A stationary bicycle comprising:

(a) a frame;

(b) a pair of opposed crank arms connected to a drive system to provide resistance to pedaling;

(c) a seat; and (d) a pedal associated with each crank arm including:

(i) a platform having a top and bottom surface and retainer on the top surface of said platform to establish the position of the rider's foot on the platform;

(ii) a pedal axle secured to said platform generally aligned with the heel of the rider's foot when on the platform, said pedal axle attachably secured to the crank arm; and (iii) counterbalance means to assist in maintaining the pedal assembly in a balanced condition as the pedal is rotated.

* * * * *